US005687494A

United States Patent [19]

Laurent

[11] Patent Number: 5,687,494

[45] Date of Patent: Nov. 18, 1997

[54] CYLINDRICAL OBJECT DISPLAYING BADGE

[76] Inventor: Ronald D. Laurent, 420½ Violet Ave., Monrovia, Calif. 91016

[21] Appl. No.: 419,459

[22] Filed: Apr. 10, 1995

[51] Int. Cl.[6] ..... A44C 3/00

[52] U.S. Cl. ..... 40/1.6; 63/19

[58] Field of Search ..... 40/1.5, 1.6, 661, 40/152, 152.1; 63/18, 19, 20

[56] References Cited

U.S. PATENT DOCUMENTS

| | | | |
|---|---|---|---|
| D. 311,457 | 10/1990 | Shapiro . | |
| D. 315,118 | 3/1991 | Davison et al. . | |
| 574,497 | 1/1897 | Seidel | 40/1.6 |
| 982,221 | 1/1911 | Sadler | 63/19 |
| 1,050,224 | 1/1913 | Nederland | 63/19 |
| 1,205,546 | 11/1916 | Kendall | 63/19 X |
| 1,534,684 | 4/1925 | Chilson | 63/18 X |
| 2,262,548 | 11/1941 | Genser | 63/19 |
| 2,863,307 | 12/1958 | Donle | 63/19 |
| 3,618,338 | 11/1971 | Sauer | 63/19 |
| 3,810,325 | 5/1974 | Köper . | |
| 4,305,215 | 12/1981 | Smith . | |
| 4,961,275 | 10/1990 | Klein . | |
| 5,251,259 | 10/1993 | Mosley . | |

*Primary Examiner*—Kenneth J. Dorner
*Assistant Examiner*—Cassandra Davis

[57] ABSTRACT

A cylindrical object displaying badge for displaying cylindrical objects known as "pogs" "milk caps" and "slammers" relative to an individual or object. The inventive device includes an inner container having a securing pin coupled to a rear surface thereof for engaging to an object such as an article of clothing. An outer container is pivotally mounted to the inner container and can be opened or closed relative thereto by a snap latch. Each container operates to retain at least one pog or milk cap or slammer therewithin for display through the transparent material of the container. A pair of cover plates close the inner and outer containers to permit displaying of the cylindrical objects with the outer container opened relative to the inner container.

1 Claim, 3 Drawing Sheets

PRIOR ART

CYLINDRICAL OBJECT DISPLAYING BADGE

BACKGROUND OF THE INVENTION

1. Field of the Invention

The present invention relates to display badges and more particularly pertains to a cylindrical object displaying badge for displaying cylindrical objects relative to an individual or object.

2. Description of the Prior Art

The use of display badges is known in the prior art. More specifically, display badges heretofore devised and utilized are known to consist basically of familiar, expected and obvious structural configurations, notwithstanding the myriad of designs encompassed by the crowded prior art which have been developed for the fulfillment of countless objectives and requirements.

Known prior art display badges include U.S. Pat. No. 5,251,259; U.S. Pat. No. 4,961,275; U.S. Pat. No. 4,305,215; U.S. Pat. No. 3,810,325; U.S. Design Pat. No. 311,457; and U.S. Design Pat. No. 315,118.

While these devices fulfill their respective, particular objectives and requirements, the aforementioned patents do not disclose a cylindrical object displaying badge for displaying cylindrical objects which includes an inner container having a securing pin coupled to a rear surface thereof for engaging to an article of clothing, an outer container pivotally mounted to the inner container which can be opened or closed relative thereto, with each container operating to retain at least one pog or milk cap or slammer therewithin for display through the transparent material of the container, and a pair of cover plates closing the inner and outer containers to permit displaying of the cylindrical objects with the outer container opened relative to the inner container.

In these respects, the cylindrical object displaying badge according to the present invention substantially departs from the conventional concepts and designs of the prior art, and in so doing provides an apparatus primarily developed for the purpose of displaying cylindrical objects known as "pogs" "milk caps" and "slammers" relative to an individual or object.

SUMMARY OF THE INVENTION

In view of the foregoing disadvantages inherent in the known types of display badges now present in the prior art, the present invention provides a new cylindrical object displaying badge construction wherein the same can be utilized for displaying cylindrical objects relative to an individual or object. As such, the general purpose of the present invention, which will be described subsequently in greater detail, is to provide a new cylindrical object displaying badge apparatus and method which has many of the advantages of the display badges mentioned heretofore and many novel features that result in a cylindrical object displaying badge which is not anticipated, rendered obvious, suggested, or even implied by any of the prior art display badges, either alone or in any combination thereof.

To attain this, the present invention generally comprises a cylindrical object displaying badge for displaying cylindrical objects known as "pogs" "milk caps" and "slammers" relative to an individual or object. The inventive device includes an inner container having a securing pin coupled to a rear surface thereof for engaging to an object such as an article of clothing. An outer container is pivotally mounted to the inner container and can be opened or closed relative thereto by a snap latch. Each container operates to retain at least one pog or milk cap or slammer therewithin for display through the transparent material of the container. A pair of cover plates close the inner and outer containers to permit displaying of the cylindrical objects with the outer container opened relative to the inner container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cylindrical object displaying badge apparatus and method which has many of the advantages of the display badges mentioned heretofore and many novel features that result in a cylindrical object displaying badge which is not anticipated, rendered obvious, suggested, or even implied by any of the prior art display badges, either alone or in any combination thereof.

It is another object of the present invention to provide a new cylindrical object displaying badge which may be easily and efficiently manufactured and marketed.

It is a further object of the present invention to provide a new cylindrical object displaying badge which is of a durable and reliable construction.

An even further object of the present invention is to provide a new cylindrical object displaying badge which is susceptible of a low cost of manufacture with regard to both materials and labor, and which accordingly is then susceptible of low prices of sale to the consuming public, thereby making such cylindrical object displaying badges economically available to the buying public.

Still yet another object of the present invention is to provide a new cylindrical object displaying badge which provides in the apparatuses and methods of the prior art some of the advantages thereof, while simultaneously overcoming some of the disadvantages normally associated therewith.

Still another object of the present invention is to provide a new cylindrical object displaying badge for displaying cylindrical objects known as "pogs" and "milk caps" and "slammers" relative to an individual or object.

Yet another object of the present invention is to provide a new cylindrical object displaying badge which includes an inner container having a securing pin coupled to a rear surface thereof for engaging to an article of clothing, and an outer container pivotally mounted to the inner container which can be opened or closed relative thereto, with each container operating to retain at least one pog or milk cap or slammer therewithin for display through the transparent material of the container.

Even still another object of the present invention is to provide a new cylindrical object displaying badge which further includes a pair of cover plates closing the inner and outer containers to permit displaying of the cylindrical objects with the outer container opened relative to the inner container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
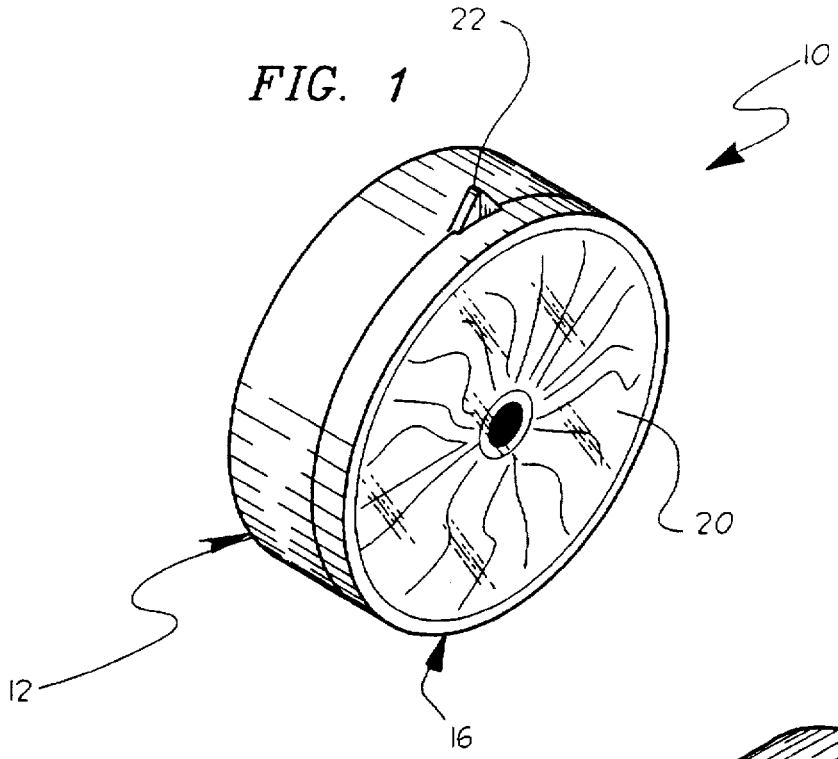
FIG. 1 is an isometric illustration of a cylindrical object according to the present invention.

With reference now to the drawings, and in particular to FIGS. 1–7 thereof, a new cylindrical object displaying badge embodying the principles and concepts of the present invention and generally designated by the reference numeral 10 will be described.

Figure 2:
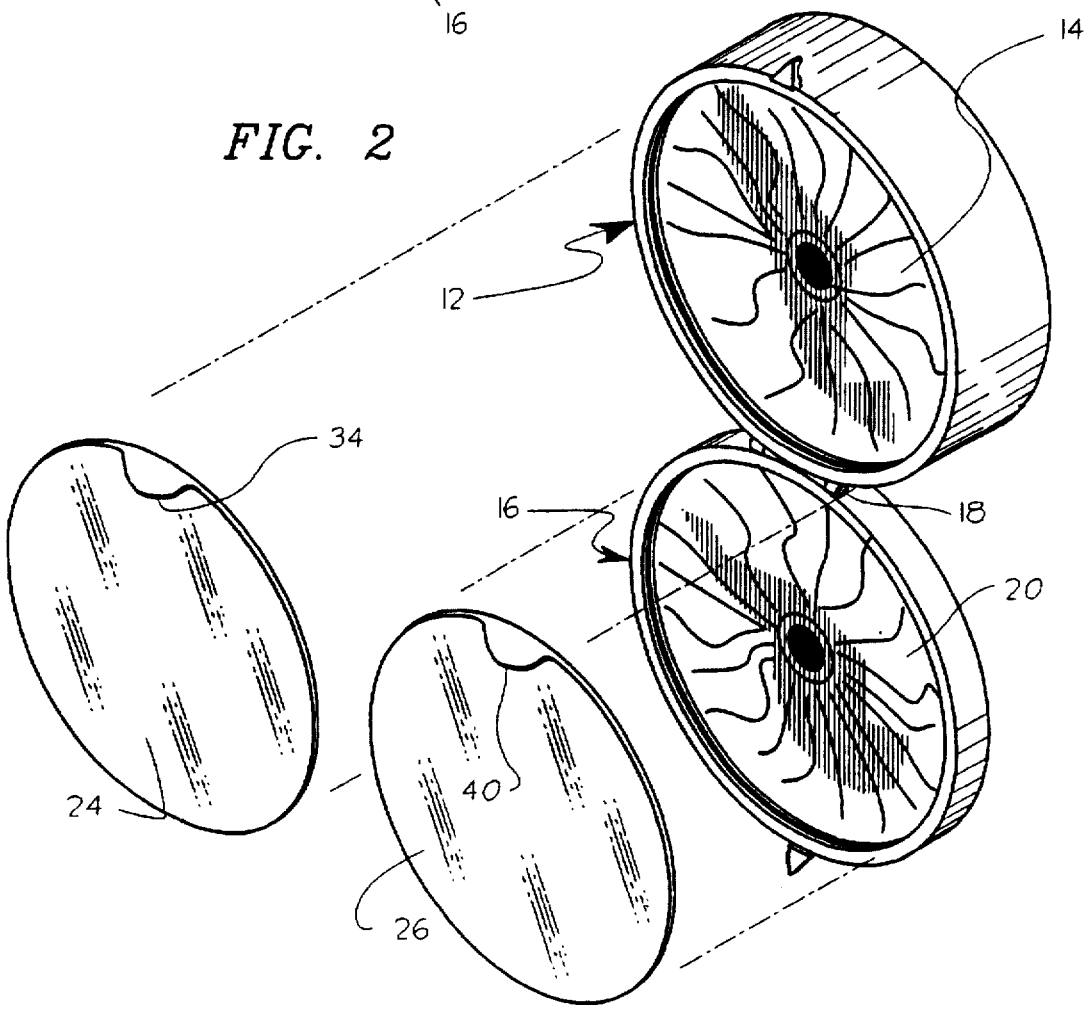
FIG. 2 is an exploded isometric illustration of the present invention in an open configuration.
Figure 3:
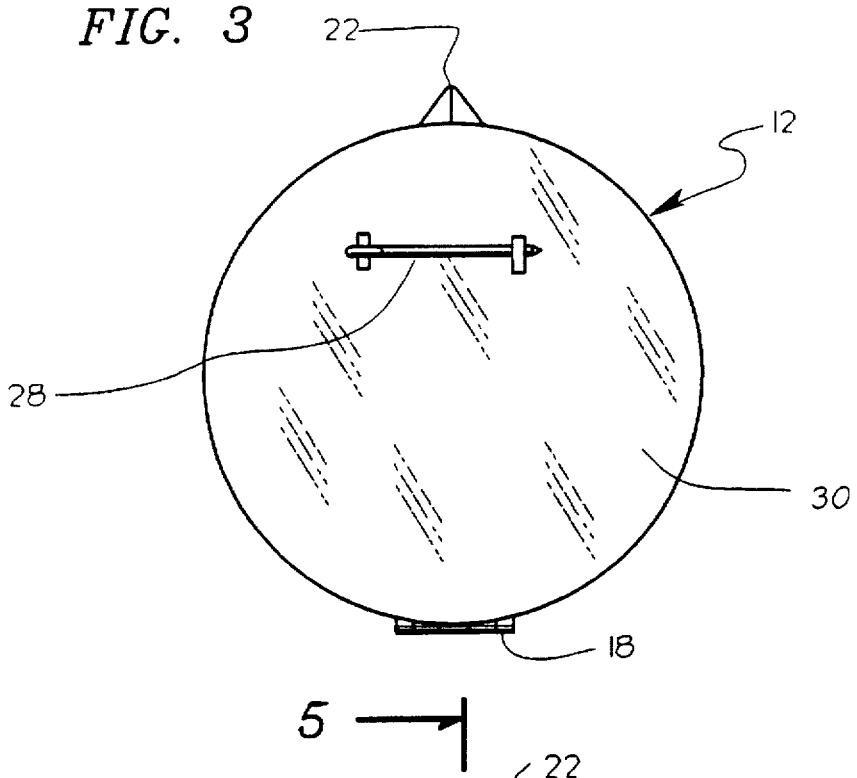
FIG. 3 is a rear elevational view of the invention.
Figure 4:
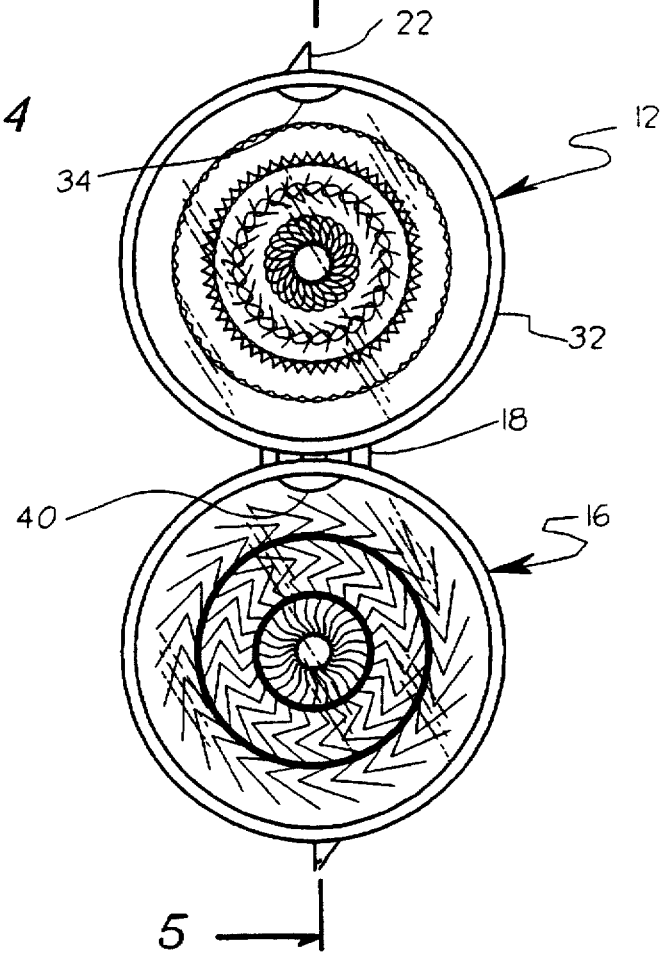
FIG. 4 is a front elevational view of the invention in the open configuration.
Figure 6:
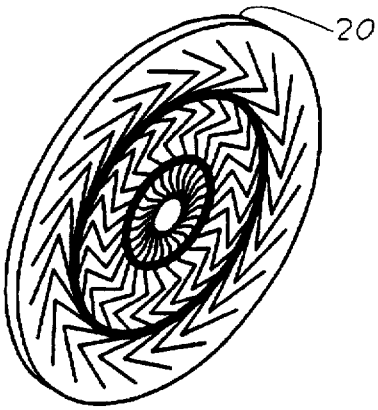
FIG. 6 is an isometric illustration of a cylindrical object referred to as a "pog" or "milk cap".
Figure 7:
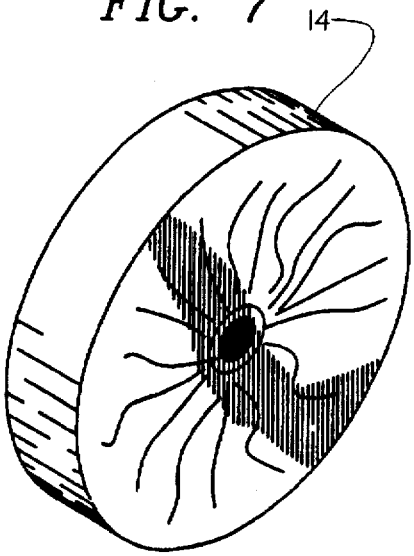
PRIOR ART FIG. 7
FIG. 7 is an isometric illustration of a further cylindrical object referred to as a "slammer".

More specifically, it will be noted that the cylindrical object displaying badge 10 comprises an inner container 12 for receiving and displaying a first cylindrical object or "slammer" 14 such as is shown in FIGS. 2 and 7. An outer container 16 is pivotally mounted to an exterior edge of the inner container 12 by a hinge 18 interposed therebetween. The outer container 16 is operable to receive and display at least one second cylindrical object or "pog" or "milk cap" 20 such as is shown in FIGS. 1, 2 and 6. A snap latch 22 secures the outer container in a closed configuration as illustrated in FIG. 1, and can be manually released to permit pivoting of the outer container into the open position illustrated in FIG. 2 of the drawings. To preclude unintentional egress of the cylindrical objects from the respective containers 12 and 16, each of the containers further includes an inner container cover plate 24 and an outer container cover plate 26, respectively, which is removably secured thereto. As shown in FIG. 3, a securing pin 28 is coupled to a back surface of the inner container for facilitating mounting of the device 10 to an object or article of clothing. By this structure, one or more styles of cylindrical objects can be contained within the present invention 10 for display in at least two configurations relative to an object or article of clothing being worn by an end user.

Referring to FIGS. 6 and 7 wherein the cylindrical objects for display by the present invention are illustrated in detail, it can be shown that the cylindrical objects 14 and 20 are characterized as having spaced and parallel front and rear faces of substantially circular configuration. An unlabeled cylindrical sidewall extends substantially orthogonally between the from and rear faces to complete the cylindrical objects 14 and 20. The cylindrical objects or "slammer" 14 and "pog" or "milk cap" 20 can be either solid or hollow in configuration and desirably include identifying indicia printed thereon of any desired design. The "slammer" 14 and the "pog" or "milk cap" 20 are each characterized as having a diameter of the circular front and rear faces which is substantially greater than an axial length of the cylindrical sidewalls thereof. However, the "slammer" 14 differs from the "pog" or "milk cap" 20 in that an axial length of the cylindrical side wall of the "slammer" is substantially greater than an axial length of the cylindrical side wall of the "pog" or "milk cap". By this disparate configuration of structure, a "slammer" 14 can be easily distinguished from a "pog" or "milk cap" 20.

Figure 5:
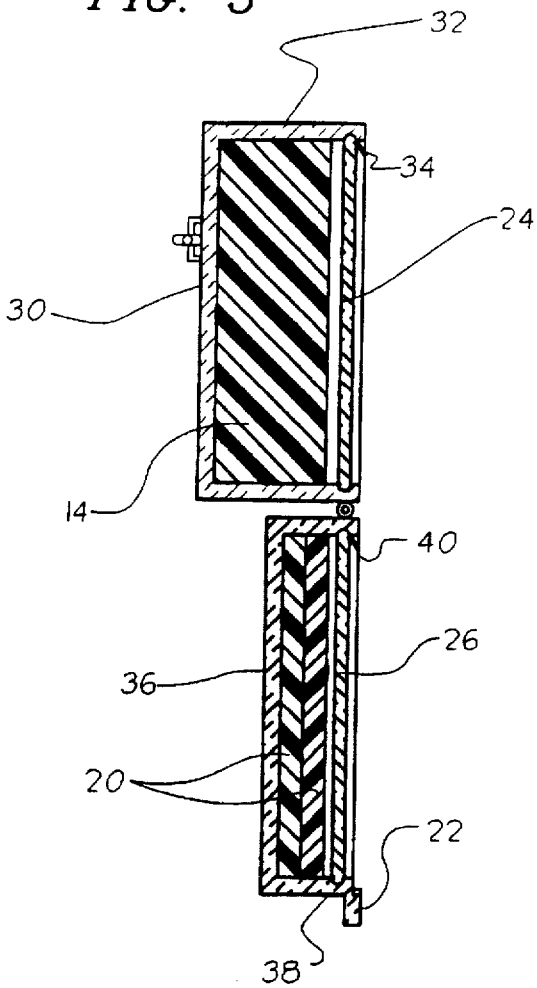
FIG. 5 is a cross sectional view taken along line 5—5 of FIG. 4.

Referring now to FIGS. 1 through 5 wherein the present invention is illustrated in detail, it can be shown that the inner container 12 comprises a substantially circular inner container base plate 30 and an inner container cylindrical side wall 32 projecting substantially orthogonally from an outer periphery of the inner container base plate. The inner container cylindrical side wall 32, as shown in the cross sectional illustration of FIG. 5, is shaped so as to receive the slammer 14 therewithin. The inner container cylindrical side wall 32 is further shaped so as to define an interior annular groove within which the outer periphery of the inner container cover plate 24 can be positioned so as to retain the inner container cover plate in a spaced relationship relative to the inner container base plate 30. To facilitate manual removal of the inner container cover plate 24 from the annular groove of the inner container cylindrical side wall, a lift tab 34 extends therefrom for manipulation by an individual.

With continuing reference to FIGS. 1 through 5, it can be shown that the outer container 16 similarly comprises a substantially circular outer container base plate 36 and an outer container cylindrical side wall 38 projecting substantially orthogonally from an outer periphery of the outer container base plate. The outer container cylindrical side wall 38, as shown in the cross sectional illustration of FIG. 5, is shaped so as to receive one or more "pogs" "milk caps" 20 therewithin. The outer container cylindrical side wall 38 is further shaped so as to define an interior annular groove within which the outer periphery of the outer container cover plate 26 can be positioned so as to retain the outer container cover plate in a spaced relationship relative to the outer container base plate 36. A lift tab 40 similarly extends from the outer container cover plate 26 for facilitating manual removal of the outer container cover plate 26 from the annular groove of the outer container cylindrical side wall.

As shown in FIG. 2, the hinge 18 is interposed between outer exterior surfaces of the cylindrical side walls 32 and 38 of the containers 12 and 16. The separable portions of the snap latch 22 are each mounted to diametrically opposed portions of the respective cylindrical side walls 32 and 38 and are laterally offset relative to one another such that mutual engagement therebetween will occur when the device is closed into the position illustrated in FIG. 1. By this structure, the invention 10 can be utilized to display at least one pog or milk cap 20 and slammer 14 as described above.

Preferably, the containers 12 and 16, as well as the cover plates 24 and 26 are constructed entirely of a transparent material enabling viewing of the contents therethrough. However, the present invention may also be constructed to translucent or opaque materials along selected portions of the containers. For example, the cylindrical sidewalls 32 and 38 of the containers 12 and 16 can be formed of a translucent or opaque material, with only the cover plates 24 and 26 and the outer container base plate 36 being constructed of a transparent material.

In use, the cylindrical object displaying badge 10 according to the present invention can be easily utilized to display one or more pogs or milk caps and at least one slammer for display and/or use thereof when separated by opening from the respective container 12 and 16. The present invention may be constructed in a variety of colors and may include exterior ornamental indicia as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cylindrical object displaying badge comprising:

an inner container formed of a substantially transparent material;

an outer container formed of a substantially transparent material pivotally mounted to an edge of the inner container;

said inner container incorporating a first axial length substantially greater than an axial length of the outer container;

a closure means for releasably securing the outer container to the inner container in a closed configuration which can be manually released to permit pivoting of the container in an open position;

an inner transparent retaining plate removably secured to said inner container as a means for releasably securing a first disk-shaped object within said inner container;

an outer transparent retaining plate removably secured to said outer container as a means for releasably securing a second disk shaped object within the outer container;

a securing device coupled to a surface of the inner container as a means for mounting the badge to an article of clothing;

said outer container further comprising a circular outer base plate and substantially cylindrical outer side wall projecting substantially orthogonally from an outer periphery of the outer base plate; wherein said outer cylindrical side wall is shaped to define an annual retaining groove adapted to receive the periphery of the outer retainer plate so as to secure the outer retaining plate in a spaced relationship relative to the outer base plate;

said inn container further comprising a circular inner base plate and substantially cylindrical inner side wall projecting substantially orthogonally from an outer periphery of the inner base plate; wherein said inner cylindrical side wall is shaped to define an annual retaining groove adapted to receive the periphery of the inner retainer plate so as to secure the inner retaining plate in a spaced relationship relative to the inner base plate;

wherein the inner and outer retaining plates each include a lift tab extending from the peripheral thereof toward the center of the plates as a means for facilitating manual removal of the inner and outer retaining plates from the annual groove of the inner and outer containers, respectively.

* * * * *